US005127164A

United States Patent [19]

Belcourt et al.

[11] Patent Number: 5,127,164

[45] Date of Patent: Jul. 7, 1992

[54] ICE SURFACE LINE APPLICATOR

[76] Inventors: Gaetan Belcourt, 5138 Outremont Blvd., Hanmer Ontario, Canada, P0M 1Y0; Fernand Roy, 3248 Kalmo Road, Val-Caron Ontario, Canada, P0M 3A0

[21] Appl. No.: 733,156

[22] Filed: Jul. 19, 1991

[51] Int. Cl.[5] ..... B43L 9/04; B44C 7/06

[52] U.S. Cl. ..... 33/27.03; 156/577; 156/390

[58] Field of Search ..... 33/27.03, 27.04, 27.02, 33/27.01, 18.1; 206/389, 410, 411; 156/577, 574, 390

[56] References Cited

U.S. PATENT DOCUMENTS

| | | | |
|---|---|---|---|
| 2,904,206 | 9/1959 | Bertschinger | 156/577 |
| 2,949,206 | 8/1960 | Figge | 156/390 |
| 3,405,447 | 10/1968 | Pfeffer | 33/27.03 |
| 4,022,651 | 5/1977 | Larkins et al. | 33/27.02 |
| 4,241,506 | 12/1980 | LeBlanc et al. | 33/27.03 |
| 4,376,007 | 3/1983 | Eigenmann | 156/577 |
| 4,761,201 | 8/1988 | Nichols, Jr. | 156/577 |
| 4,775,442 | 10/1988 | Januska | 156/577 |
| 4,794,699 | 1/1989 | Perna | 33/27.03 |
| 4,923,559 | 5/1990 | Kennedy et al. | 156/577 |
| 5,040,299 | 8/1991 | Hwang | 33/27.03 |

*Primary Examiner*—William A. Cuchlinski, Jr.
*Assistant Examiner*—C. W. Fulton
*Attorney, Agent, or Firm*—McConnell and Fox

[57] ABSTRACT

A machine is provided for dispensing ice marking tape in a regular manner suitably moistened so that it will adhere to the ice surface. The pattern described by the applicator is determined by suitable means such as a radius arm which is connected to the center of any circle which is to be defined or suitable linear guides. The machine provides a simple method of directly applying markings to ice without multiple step processes being required, such as marking and painting.

15 Claims, 4 Drawing Sheets

ICE SURFACE LINE APPLICATOR

FIELD OF THE INVENTION

This invention relates to a method of applying marks to ice surfaces used for games such as hockey, ringette, broomball, etc.

DESCRIPTION OF THE PRIOR ART

In the past it has been customary to place the necessary markings on ice surface, such as hockey rinks, by means of paint. In marking the face-off circles in particular and other curved markings, it has been necessary in the past to apply marks to the surface defining the desired pattern, for example, by placing two felt pen markers spaced apart at the end of a bar and rotating the bar about its other end thus scribing two circles on the ice. The area between the two scribed circles is then manually painted with a water-based paint. Obviously this is a slow, laborious process since the person applying the marking has to carefully paint between the scribed lines and avoid spills which takes some time.

A paint dispenser has been proposed to replace the manual process. This system provides a paint tank which supplies paint to stationary brush. The dispenser is then pushed over the ice painting a line the width of the brush. Such dispensers still have many drawbacks since they require paint preparation, rinsing and cleaning, and still do not prevent spills, waste of paint and are subject to clogging and freezing of the brush.

In the past it has been known to use porous material such as paper instead of paint for making straight lines, for example, the blue line and other straight markings on the ice surface. European Patent Application 0,139,948 published Aug. 14, 1984 describes a suitable material for embedding in an ice surface and suggests suitably open fibered material may be used. However, these materials have always been applied either for straight lines which can easily be manually applied, or in pre-manufactured patterns which are simply arranged on the ice manually.

None of the foregoing methods provides a means of applying controlled regular circular markings to an ice surface.

SUMMARY OF THE INVENTION

In accordance with the present invention, a machine is provided which dispenses water permeable tape in proper condition for adhering to an ice surface. A dispenser is arranged to be conveniently moved in a regular circular pattern by means of an arm attached to one side of the dispenser and anchored at its other end to the point defining the desired center of the circle.

A clearer understanding of our invention may be had from a consideration of the following description and drawings in which:

Figure 1:
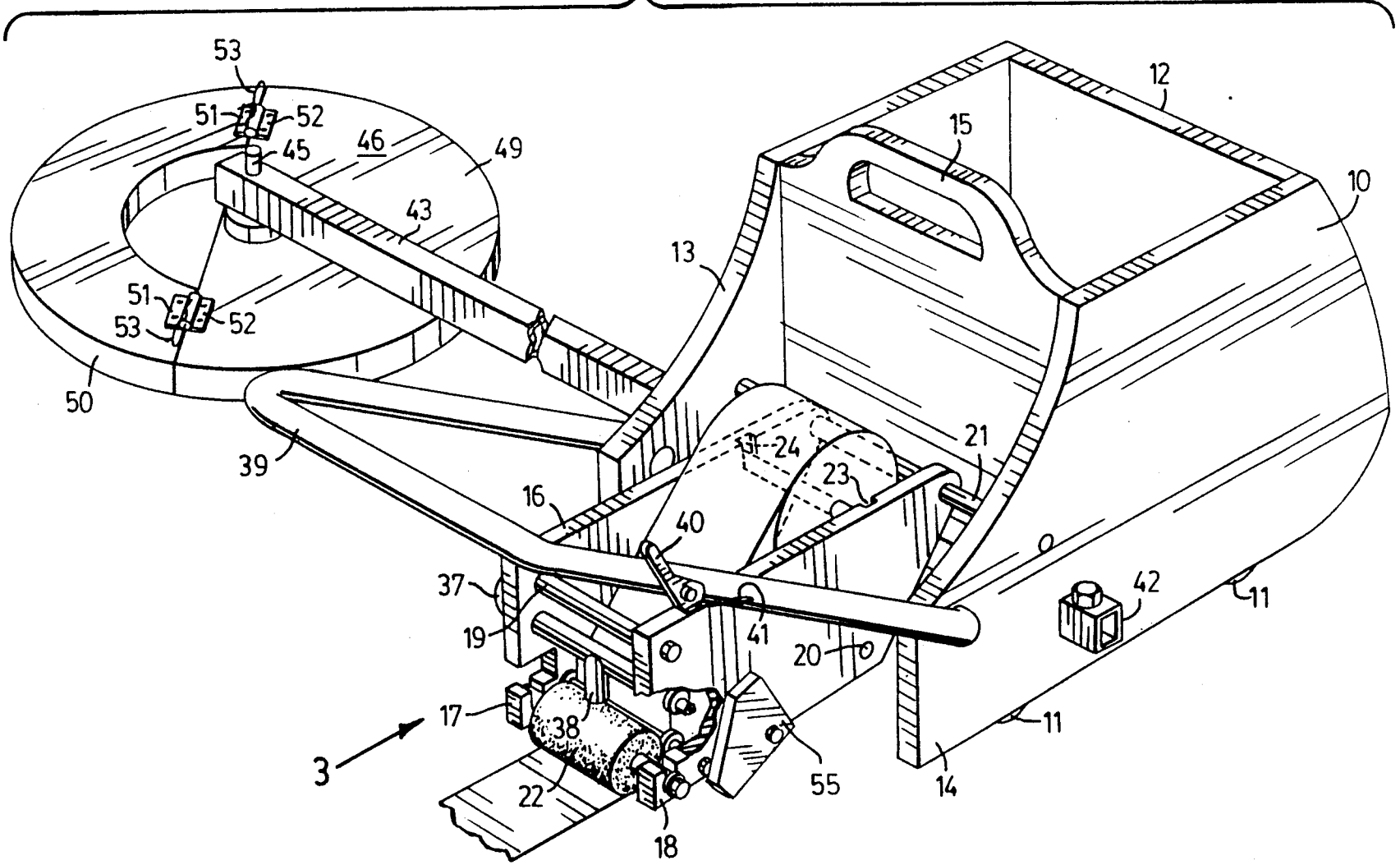
FIG. 1 is a perspective view of the tape dispenser.
Figure 2:
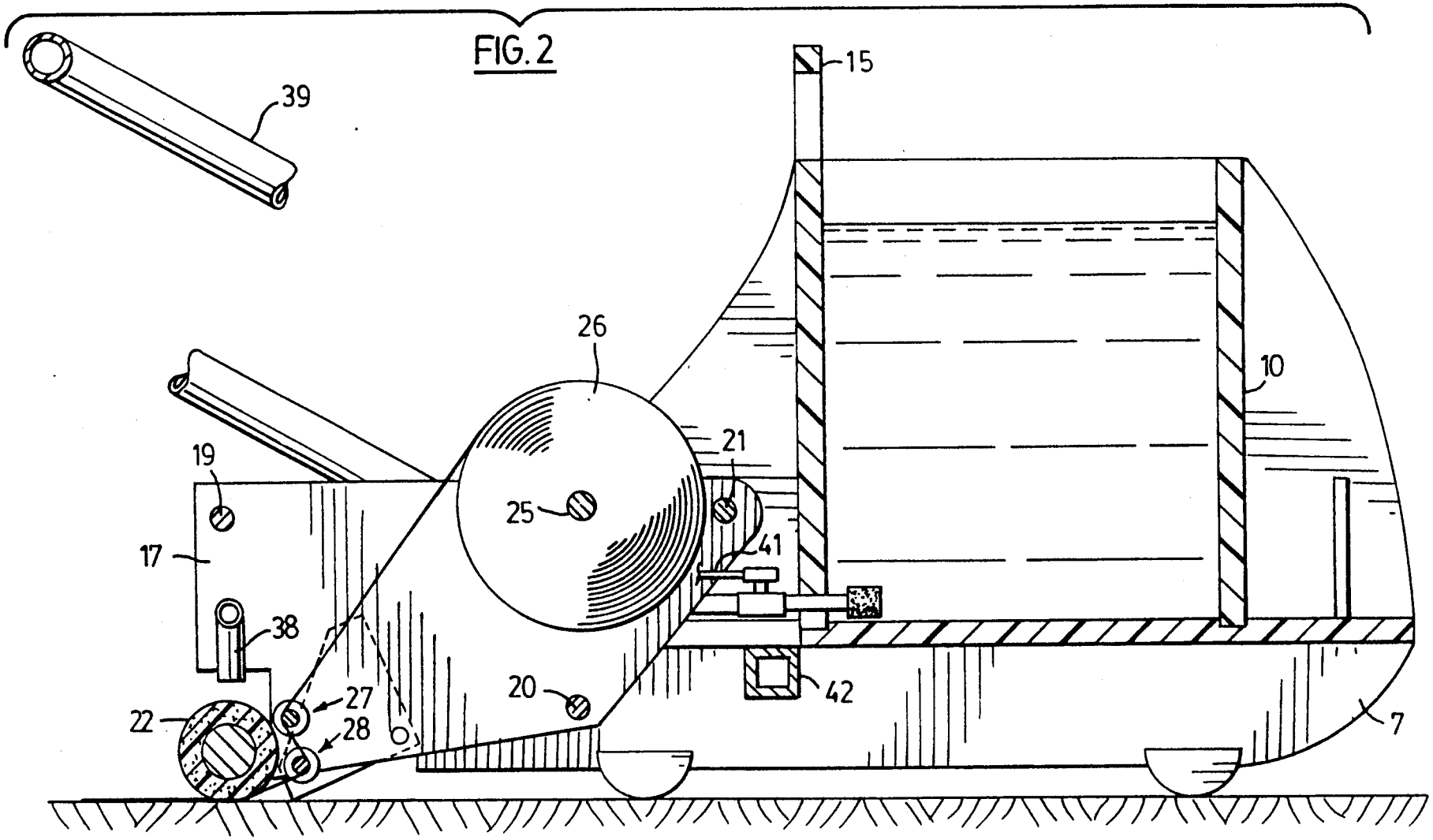
FIG. 2 is a side view in section of the dispenser.
Figures 3, 3A:
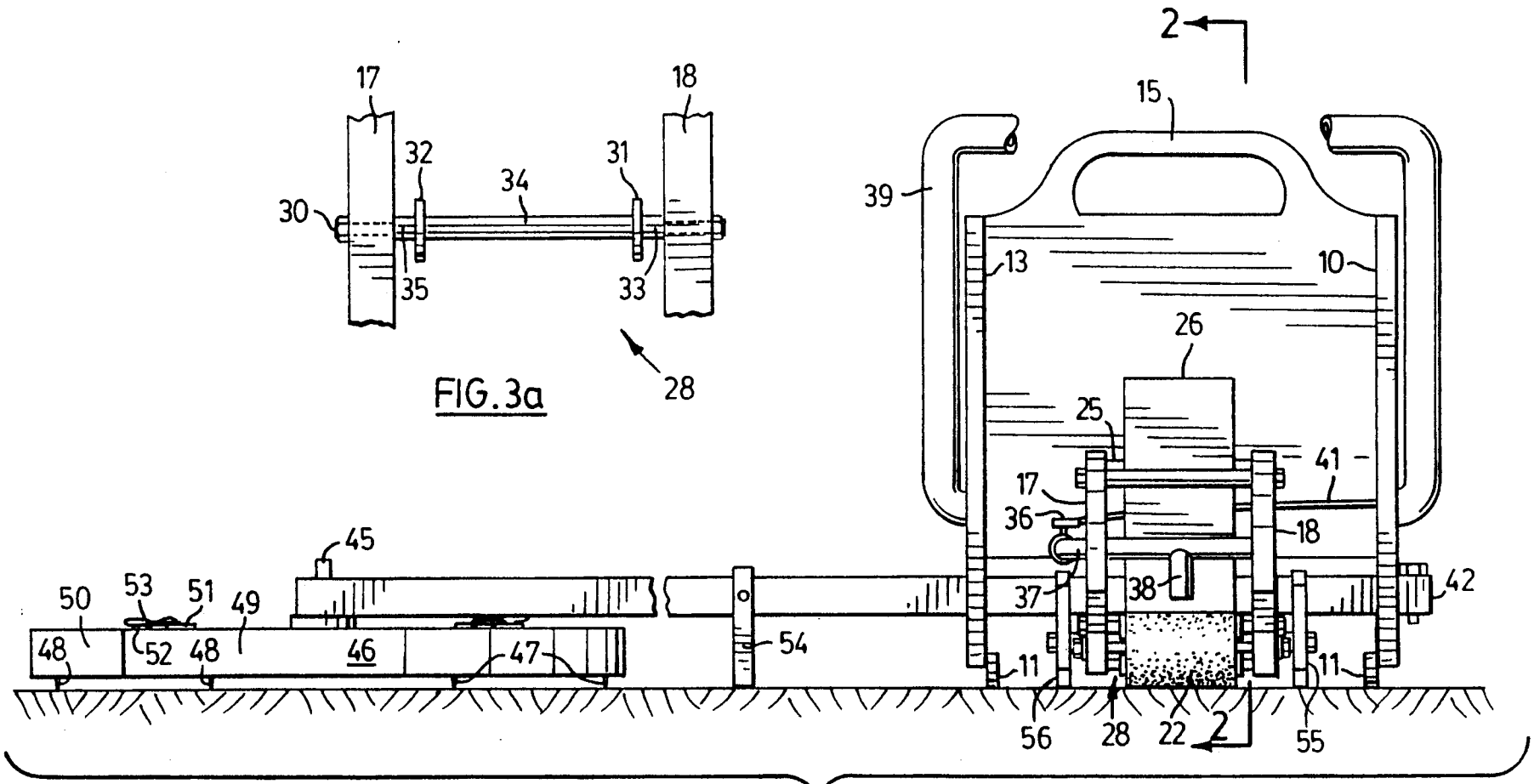
FIG. 3 is a rear view of the dispenser in operating position and attached to its guide.
FIG. 3A is a detail view of a tape guide used in the dispenser.

Considering first FIGS. 1-3, it will be seen that the machine consists of a chassis 10 mounted on skids 11 at each corner, which skids protrude from the bottom of the chassis. The chassis includes a water reservoir 12 and two extending side walls 13 and 14. The rear wall of the water reservoir extends upwards to provide a lifting handle for the machine designated 15.

The applicator 16 comprises a pair of side walls 17 and 18 maintained spaced apart from each other by spacer rods 19 and 20 and the pivot rod 21 which passes through the side walls 13 and 14 of the chassis and pivotally supports the applicator. Mounted at the rear of the applicator is a metal roller 22 having a spongy porous surface coating made, for example, of open-pored polyurethane foam. Near the pivot point of the applicator are a pair of slots 23 and 24 which receive the ends of a spindle 25 and retain a roll of paper marking tape designated 26. A pair of guides 27 and 28 pass between the walls 17 and 18 of the applicator. These guides consist of rods and spacers and washers which define the location of the tape. The washers are spaced apart on the rods, a distance equal to the width of the tape by means of spacers. As shown in FIG. 3A, for example, one of the guides 28 is shown in detail and consists of a rod 30 which passes between the walls 17 and 18 and supports two washers 31 and 32 which are located by spacers 33, 34 and 35 which define a gap between the washers 31 and 32 equal to the width of the paper tape 26.

A valve 36 at the bottom of the water reservoir 12 is connected through tube 37 to an outlet 38 supported by the side walls 17 and 18 and located immediately over roller 22. The handle 39 consists of a "U" shaped member formed from tubing of circular or rectangular cross-section which is pivotally connected to the extension walls 13 and 14 of the chassis and is of sufficient size to permit the user to conveniently push the machine from a comfortable location to the rear of the machine. The water control lever 40 is connected by a cable 41 through the interior of handle 39 down to control valve 36. A mounting shaft 42 extends through the chassis walls 13 and 14 and may be connected to an extension bar 43 by means of a pin 44.

Extension bar 43 determines the diameter of the circle to be marked and may be of any desirable length in accordance with the requirements of the game lay-out. The other end of the extension bar 43 is connected to a pivot point 45 on an anchor block 46. The anchor block is a circular plastic block including locating projecting points, only two of which may be seen, 47 and 48. The block 46 actually consists of two separable portions 49 and 50 held together by hinge members which include plates 51 and 52 fastened to portions 49 and 50 and locked to each other by cotter pins, such as pin 53. An idler block 54 may be located on the extension bar 43 intermediate between the machine and the anchor to prevent sagging of the extension bar. Pivotally mounted on each of the walls 17 and 18 of the applicator are a pair of substantially triangular support blocks 55 and 56.

OPERATION

Figure 4:
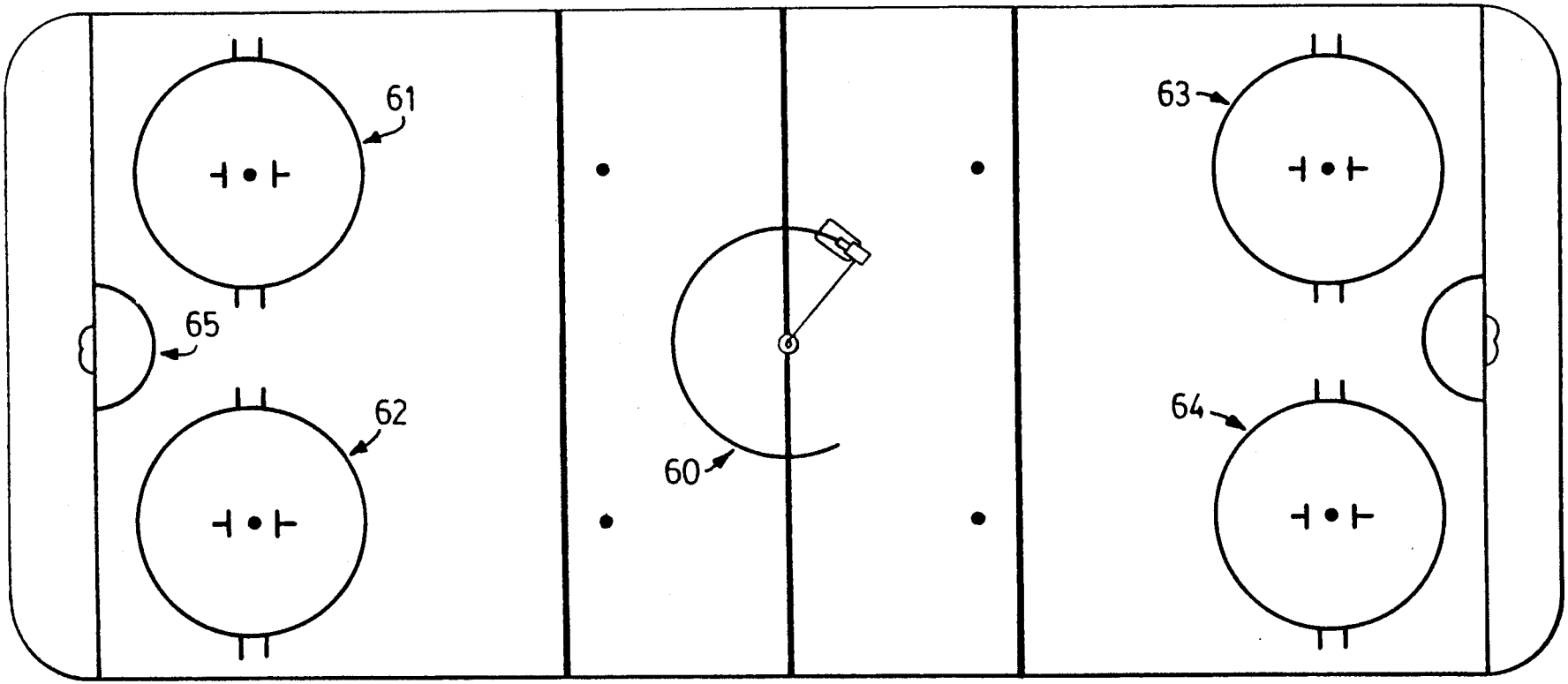
FIG. 4 is a plan view of a typical ice rink with hockey markings.

In operation, the water reservoir 12 is filled with water, with the water valve 36 in the off position. A roll of suitable paper tape 26 used for ice marking is mounted on spindle 25 and inserted in the slots 23 and 24. The end of the tape 26 is fed out over the guide 27 and under the guide 28 and pulled out so that it extends slightly beyond the end of the applicator 16. The anchor block 46 is located at the desired center of the circle by pressing down firmly until the anchor pins, such as pins 47 and 48, are embedded in the ice. The extension bar is slipped over the pivot 45 and is connected to mounting shaft 42 by means of pin 44. The length of the extension bar 43 is selected to describe the desired circle. The end of the tape 26 is moistened and held down on the ice until it adheres. The operator turns on the water valve 36 and pushes the machine in a smooth and regular manner around the circle. The flow of water is sufficient to wet the ape 26 and extends the width of the roller 22 which is wider than the tape 26, thus providing an ice sheath extending over the tape and a small distance beyond each side of the tape. When the circle is complete, the operator turns off the water, cuts the tape 26 and removes the machine to a new location. Having completed the face-off circles, such as circles 60, 61, 62, 63 and 64, as shown in FIG. 4, the length of the extension arm may now be changed and the circles defining the goal crease may be marked, such as circle 65 on FIG. 4. The anchor block may now be modified by folding back portion 49, the anchor may then be placed against the dasher boards in the location of the referee's crease and, with the proper length of extension arm, the referee's crease marked.

While the operation has been described thus far with reference to circular markings, it will be understood that straight lines may also be applied if desired. A suitable tape and guide or complete applicator assembly may be installed to accommodate the tape required for the blue lines and red lines and the applicator rather than being guided by an extension bar may be guided by cables extending across the rink and held on turn buckles fastened to the dasher boards. With the cables in place the applicator can be coupled through any suitable connecter mounted on the mounting shaft 42 and thus guided in a straight line across the ice. Thus, while intended primarily for providing circular markings, the marker can also be used for applying linear marking as desired.

When the machine is lifted from the ice by its handle, support blocks 55 and 56 pivot about their apexes and their broad bases provide a pair of supports which hold the applicator up from the ice surface and prevent the roller 22 from touching the ice and thus being frozen. This also prevents the roller 22 from developing a flat spot during storage.

It is desirable that all the materials used in construction of the machine be those which will not corrode, for example, the major body can be formed from suitable plastic while all metallic parts, such as the handle, the roller, extension rods, etc., can be made from stainless steel, aluminium, brass or bronze.

While no specific dimensions have been given, it will be understood that the volume of the water reservoir should be sufficient to hold four or five litres of water; the guides should be designed to accept the standard width of marking tape; the roller sufficiently heavy to force the tape firmly against the ice and press out air bubbles and the water flow, when the valve is opened, sufficient to wet the tape and provide a sheath of ice extending over the tape and beyond each edge.

We claim:

1. An ice marking tape dispenser for applying regular marking patterns to an ice surface comprising a chassis including a water reservoir, an applicator having first and second ends pivotally mounted at its first end on said chassis, said applicator comprising a pair of side walls fixedly spaced from each other, means for rotatably supporting a roll of ice marking tape between said side walls, a resilient water absorbent roller mounted at said second end of said applicator, guide means for receiving and guiding said tape onto said roller, a water outlet adjacent said roller and means controllably applying water from said reservoir to said roller, said chassis and said applicator being so related that when said chassis is normally supported on a flat surface said roller firmly engages said flat surface.

2. A dispenser as claimed in claim 1 wherein said chassis is mounted on skids.

3. A dispenser as claimed in claim 2 including means to control the path of said chassis when propelled.

4. A dispenser as claimed in claim 3 wherein said means to control the path of said chassis comprises a radius arm connected at one of its ends to said chassis and the other of its ends to a fixable pivot point.

5. A dispenser as claimed in claim 4 including means to support said second end of said applicator above the surface on which said chassis is supported with said roller out of engagement with said surface when said dispenser is inoperative.

6. A dispenser as claimed in claim 1 wherein said roller is a metal roller with a spongy porous water absorbing surface.

7. A dispenser as claimed in claim 6 wherein said means for controllably applying water to said roller comprises a manually operable valve adjacent the bottom of said reservoir and a flexible tube connecting the outlet of said valve to said water outlet which overlies said roller when in normal operating position.

8. A dispenser as claimed in claim 7 including means to control the path of said chassis when propelled.

9. A dispenser as claimed in claim 4 including a support block mounted on said radius arm intermediate the said ends of said arm.

10. An ice marking tape dispenser for applying regular marking patterns to an ice surface comprising a chassis including a water reservoir and having front and rear ends and mounted on skids at each of said ends, a handle for manually propelling said chassis over the ice on said skids, said handle pivotally connected to said chassis adjacent its rear end, an applicator having first and second ends pivotally mounted at its first end on the rear end of said chassis, said applicator comprising a pair of side walls, means to rotatably support a roll of ice marking tape between said side walls, a resilient water absorbent roller mounted at said second end of said applicator, guide means for receiving and guiding said tape onto the lower surface of said roller, a manual actuatable valve at the bottom of said water reservoir connected by a flexible tube to an outlet over the upper surface of said roller, said chassis and said applicator being so arranged that when said skids support said chassis on a flat surface said roller firmly engages said flat surface.

11. An ice marking tape dispenser as claimed in claim 10 including means to control the path of said chassis when propelled.

12. An ice marking tape dispenser as claimed in claim 11 wherein said means to control the path of said chassis comprises an arm fastened at its one end to said chassis and pivotally connected at its other end to an anchor block whereby, when said chassis is propelled it describes a circle centered at said anchor block.

13. An ice marking tape dispenser as claimed in claim 12 wherein said anchor block is a flat plate including projecting points for engaging an ice surface.

14. An ice marking tape dispenser as claimed in claim 12 including a support block intermediate said one end and said other end of said arm and engaging said flat surface to support said arm.

15. An ice marking tape dispenser as claimed in claim 10 including freely pivoting support means at the second end of said applicator which rotate when said dispenser is lifted off said flat surface and support said second end of said applicator and said roller above said flat surface when said dispenser is lowered directly downward onto said flat surface.

* * * * *